US010576756B2

(12) United States Patent
Rietbergen et al.

(10) Patent No.: US 10,576,756 B2
(45) Date of Patent: Mar. 3, 2020

(54) METHOD FOR FORMING AN IMAGE ON A RECORDING MEDIUM IN A PRINTER

(71) Applicant: Océ Holding B.V., Venlo (NL)

(72) Inventors: Mark Rietbergen, Venlo (NL); Cornelis P. M. Van Heijst, Venlo (NL)

(73) Assignee: CANON PRODUCTION PRINTING HOLDING B.V., Venlo (NL)

( * ) Notice: Subject to any disclaimer, the term of this patent is extended or adjusted under 35 U.S.C. 154(b) by 0 days.

(21) Appl. No.: 16/235,576

(22) Filed: Dec. 28, 2018

(65) Prior Publication Data

US 2019/0134995 A1 May 9, 2019

Related U.S. Application Data

(63) Continuation of application No. PCT/EP2017/065965, filed on Jun. 28, 2017.

(30) Foreign Application Priority Data

Jul. 5, 2016 (EP) ..... 16178000

(51) Int. Cl.
*B41J 11/00* (2006.01)
*B41M 7/00* (2006.01)
*B41J 2/135* (2006.01)

(52) U.S. Cl.
CPC ..... *B41J 11/002* (2013.01); *B41J 2/135* (2013.01); *B41M 7/0081* (2013.01)

(58) Field of Classification Search
CPC ..... B41J 11/002; B41J 11/0015; B41J 2/01; B41J 2/135; B41M 7/0081; B41M 5/0011; B41M 7/00
See application file for complete search history.

(56) References Cited

U.S. PATENT DOCUMENTS 6,543,890 B1 4/2003 Ylitalo et al.
8,764,153 B2 * 7/2014 Sanada ..... B41J 11/002 347/102

(Continued)

OTHER PUBLICATIONS

International Search Report (PCT/ISA/210) issued in PCT/EP2017/065965 , dated Sep. 18, 2017.

(Continued)

*Primary Examiner* — Jannelle M Lebron
(74) *Attorney, Agent, or Firm* — Birch, Stewart, Kolasch & Birch, LLP

(57) ABSTRACT

A method is provided for forming an image on a recording medium in a printer, the printer comprising a print head assembly for applying a curable ink on a recording medium to form the image, a transport path arranged for moving the recording medium in a transport direction along the print head assembly and a curing system; said curing system comprising a curing source, which curing source is arranged extending over the transport path in the transverse direction; the method comprising the steps of: moving the recording medium through the transport path in a step-wise movement in the transport direction along the print head assembly and the curing system; applying the curable ink on the recording medium by the print head assembly to form the image; and curing the curable ink, which is applied on the recording medium, by the curing source in a curing zone on the recording medium, the curing zone extending over the transport path in a transverse direction, the transverse direction being substantially perpendicular to the transport direction; wherein the curing step comprises moving the curing zone along the transport direction through the transport path in response to the step-wise movement of the recording medium.

13 Claims, 6 Drawing Sheets

(56) References Cited

U.S. PATENT DOCUMENTS

| | | | | |
|---|---|---|---|---|
| 9,586,414 | B2 * | 3/2017 | Kuiper | B41J 11/002 |
| 2015/0298466 | A1 | 10/2015 | Veis et al. | |

OTHER PUBLICATIONS

Written Opinion of the International Searching Authority (PCT/ISA/237) issued in PCT/EP2017/065965, dated Sep. 18, 2017.
EP Office Action 177329349 dated Nov. 19, 2019; pp. 1-8.

* cited by examiner

METHOD FOR FORMING AN IMAGE ON A RECORDING MEDIUM IN A PRINTER

CROSS REFERENCE TO RELATED APPLICATIONS

This application is a Continuation of PCT International Application No. PCT/EP2017/065965, filed on Jun. 28, 2017, which claims priority under 35 U.S.C. 119(a) to Patent Application No. 16178000.2 filed in Europe on Jul. 5, 2016, all of which are hereby expressly incorporated by reference into the present application.

FIELD OF THE INVENTION

The present invention pertains to method provided for forming an image on a recording medium in a printer. The present invention further pertains to a printer for forming an image on a recording medium.

BACKGROUND ART

It is known to form an image on a recording medium in a printer by applying a curable ink onto the medium and subsequently curing the curable ink, deposited on the recording medium, by providing a curing radiation, such as a UV radiation, onto the curable ink.

The known printer comprises a print head assembly for applying the curable ink on the recording medium to form the image and a curing system comprising a curing source for providing the curing radiation, such as a UV radiation, in a curing zone onto the curable ink deposited onto the recording medium.

The above mentioned printer further comprises a transport assembly comprising a transport path for moving the recording medium in a transport direction along the print head assembly and the curing system. The transport assembly comprises a transport pinch for driving the recording medium along the transport path. The transport pinch is arranged upstream of the print head assembly in the transport direction and controls the position of the recording medium at the print head assembly and the curing system. This arrangement supports a compact system for forming the image and curing the image on the recording medium.

The above mentioned print head assembly is moveably arranged in a transverse direction, the transverse direction being substantially perpendicular to the transport direction of the recording medium. The printer comprises a control system arranged for controlling a scan wise movement of the print head assembly in the transverse direction over the recording medium to form the image. The control system further controls the transport assembly for step-wise moving the recording medium along the transport path in response to the scan wise movement of the print head assembly in the transverse direction.

The curing zone of the curing system is arranged extending over the transport path in the transverse direction such that the curable ink deposited on the recording medium can be cured along the transverse direction at once. This arrangement of the curing zone supports a fast and reliable curing process of the curable ink on the recording medium.

It is observed that, when moving the recording medium in the transport direction along the curing system in a step-wise movement, a print quality attribute of the image, such as a gloss level of the image, may become less uniform along the transport direction.

It is the object of the present invention to provide a method for forming an image on a recording medium in a printer, the printer using a curable ink, wherein the recording medium is transported along the curing system in a step-wise movement and a uniform print quality is obtained in the image.

SUMMARY OF THE INVENTION

In an aspect of the present invention, a method is provided for forming an image on a recording medium in a printer, the printer comprising a print head assembly for applying a curable ink on a recording medium to form the image, a transport path arranged for moving the recording medium in a transport direction along the print head assembly and a curing system; said curing system comprising a curing source; the method comprising the steps of: a) moving the recording medium through the transport path in a step-wise movement in the transport direction along the print head assembly and the curing system; b) applying the curable ink on the recording medium by the print head assembly to form the image; and c) curing the curable ink, which is applied on the recording medium, by the curing source in a curing zone on the recording medium, the curing source and the curing zone extending over the transport path in a transverse direction, the transverse direction being substantially perpendicular to the transport direction; wherein the curing step c) comprises moving the curing zone along the transport direction through the transport path in response to the step-wise movement of the recording medium according to step a).

The recording medium, including the curable ink deposited on the recording medium, is moved along the curing system in a step-wise movement. The curing system provides curing of the curable ink in the curing zone, which extends over the transport path in the transverse direction, such that the image is cured along the transverse direction at once. During the curing process, the curing zone is moved in the transport direction in response to the step wise movement of the recording medium in the transport direction. In this way, the curable ink during curing in the curing zone obtains a uniform curing dose along the transport direction despite the step-wise movement of the recording medium. As a result, a uniform print quality, such as an uniform gloss level, is obtained in the image.

The curable ink may comprise at least one radiation curable component being curable in response to a curing radiation, such as a UV radiation. Alternatively, the curable ink may comprise a heat curable component being curable in response to a heat treatment of the curable ink. Additionally, the curable ink may further comprise a phase change component for forming a thermally reversible gelling phase or a thermally reversible solid phase in the curable ink. The thermally reversible solid phase of the curable ink, i.e. a phase change ink, is reversed by heating the curable ink to a temperature above a phase change temperature of the thermally reversible solid phase, thereby liquefying the curable ink again.

As defined herein, the step of curing the curable ink comprises irreversibly solidifying the ink in response to the curing process. In an example, a radiation curing process of a radiation curable ink comprises chemically transforming the curable ink in response to a curing radiation thereby permanently solidifying the ink.

The curing source is arranged extending over the transport path in the transverse direction. The curing source may be a radiation curing source, such as a UV lamp assembly. The radiation curing source may extend linear along the transverse direction over the transport path and may comprise a plurality of source elements, such as an array of LED light elements, which is distributed along the transverse direction over the transport path. In this way, the curing process can be easily provided on each part of the recording medium along the transverse direction at the same time.

The step-wise movement of the recording medium along the print head assembly and the curing system may be an iterative movement of the recording medium comprising a step of the recording medium in the transport direction and a waiting period wherein the recording medium is held stationary relative to the transport direction. Alternatively, the step-wise movement may comprise a first movement, wherein the recording medium is transported in the transport direction at a first velocity, and a second movement, wherein the recording medium is transported in the transport direction at a second velocity being different from the first velocity. In even another example, the step-wise movement may comprise a first movement, wherein the recording medium is transported in the transport direction, and a second movement, wherein the recording medium is transported along the transport path in an opposite direction to the transport direction.

The recording medium according to the present invention may be anyone of a cut sheet, a web provided from a roll and a rigid material.

In particular, during the curing step c) the curing system may be arranged for providing a uniform curing dose onto the recording medium along the transverse direction. In this way the curing dose provided onto the recording medium is equalized both along the transverse direction and along the transport direction. As a result, any variations in print quality attributes of the image along the transverse direction are minimized.

In an embodiment, during the curing step c) the curing zone is moved along the transport direction such that the velocity of the curing zone relative to the recording medium in the transport direction is substantially constant. In this way, the cure dose received in the curing zone on the recording medium is equalized along the transport direction. As a result, a print quality attribute of a curable ink, which print quality attribute is sensitive to the cure dose, is made more uniform over the image.

In an example, the movement of the curing zone may comprise a first step of moving the curing zone at a first curing zone velocity $V_{c1}$ along the transport path towards the print head assembly, while the recording medium is held stationary with respect to the transport path (i.e. velocity along the transport path is 0), and further comprise a second step of moving the curing zone at a second zone velocity $V_{c2}$ along the transport path in the transport direction away from the print head assembly, while the recording medium is moved at a recording medium velocity $V_R$ in the transport direction away from the print head assembly. In this example, the relative velocity $\Delta V_2$ between the curing zone and the recording medium ($\Delta V_2 = V_R - V_{c2}$) during the second step is substantially equal to a relative velocity $\Delta V_1$ between the curing zone and the recording medium during the first step, as $\Delta V_1 = V_{c1}$, which is the first curing zone velocity $V_{c1}$ during the first step. As a result, the curing dose provided in the curing zone medium onto the recording is equalized along the transport direction despite the step wise movement of the recording medium.

In an embodiment, in the curing step c) the curing source emits a curing radiation to the curing zone for curing the curable ink. The curing radiation may be a UV radiation, may be an electron beam radiation and may any other suitable radiation for curing the curable ink. A curing radiation may in various ways be emitted and focused to the curing zone, which extends over the transport path along the transverse direction. In an example, the curing source comprises at least one radiation lamp which emits a curing radiation, which curing radiation is reflected by a mirror assembly towards the curing zone.

In an embodiment, at least a part of the curing system is moveably arranged along the transport direction and in the curing step c) the moving step of the curing zone along the transport direction comprises moving a part of the curing system in the transport direction. The curing system may comprise a curing beam, which extends over the transport path in the transverse direction, wherein the curing beam is movably arranged in the transport direction. The curing system may further comprises two drive units, each arranged at one end of the curing beam in the transverse direction and arranged for driving the curing beam along the transport direction. In examples, the curing source, such as a radiation source, may be mounted onto the movable part of the curing system, such as a moveable curing beam, and the curing source may be arranged stationary with respect to the transport direction. The moveable part of the curing system may additionally comprise a mirror assembly for reflecting a curing radiation to the curing zone. The mirror assembly may comprise a mirror extending over the transport path along the transverse direction and may comprise an array of mirror elements distributed along the transverse direction over the transport path.

In an embodiment, the curing source comprises an array of source devices distributed along the transport direction for defining the curing zone, and in the curing step c) the moving step of the curing zone along the transport direction comprises the steps of selectively activating at least one of the source devices and selectively deactivating at least one of the source devices.

For example, the array of source devices may comprise a group of four source devices arranged along the transport direction. The curing zone may be defined along the transport direction by selectively activating two source devices arranged adjacent to one another along the transport direction from the group of four source devices. The curing zone may be moved in a transport direction along the transport direction by first activating a first source device and a second source device, being adjacent to one another, then deactivating the first source device and activating a third source device, being adjacent to the second source device and then deactivating the second source device and activating a fourth source device, being adjacent to the third source device. In this way, the curing zone is moved along the transport direction by selectively activating at least one of the source devices and selectively deactivating at least one of the source devices.

The process of selectively activating at least one of the source devices and selectively deactivating at least one of the source devices may be repeated in a reversed order to move the curing zone through the transport path in a direction opposite to the transport direction.

Alternative implementations of the number of source devices along the transport direction may suitably be selected by the person skilled in the art according to a desired length of the curing zone along the transport direction and a desired motion control of the curing zone along the transport direction.

Additionally, each source device of the array of source devices may comprise a plurality of source elements, such as a row of LEDs, which plurality of source elements is distributed along the transverse direction. This is an easily controllable assembly of source elements for providing a source device extending along the transverse direction. Furthermore a curing dose along the transverse direction may be easily controlled by adjusting the driving level of each of the source elements, such as LEDs, distributed along the transverse direction.

In an embodiment, the curing system further comprises a mirror assembly arranged for directing the curing radiation onto the curing zone, and in the curing step c) the moving step of the curing zone along the transport direction comprises rotating the mirror assembly about a rotation axis arranged substantially parallel to the transverse direction. The mirror assembly may comprise a mirror extending over the transport path along the transverse direction and may comprise an array of mirror elements distributed over the transport path along the transverse direction. In this embodiment, the mirror assembly is rotatably arranged about a rotation axis arranged substantially parallel to the transverse direction. The rotational position of the mirror assembly is controlled by the printer. The mirror assembly is arranged for directing, i.e. reflecting, the curing radiation onto the curing zone. In the curing step c) the curing zone is moved in the transport direction by rotating the mirror assembly about the rotation axis, thereby moving the angle of reflection of the curing radiation by the rotating mirror assembly such that the focus of the curing radiation onto the recording medium, i.e. the curing zone, is moved through the transport path along transport direction. This rotatable mirror assembly provides a simple way of moving the curing zone along the transport direction.

In an embodiment, in step b) the print head assembly is moved scan wise over the recording medium along the transverse direction, and wherein the scan wise movement of the print head assembly is synchronized with the step-wise movement of the recording medium of step a). In this embodiment, the image is formed by a scan wise movement of the print head assembly over the recording medium along the transverse direction. The scan wise movement of the print head assembly is synchronized with the step-wise movement of the recording medium. Preferably, each image part along the transverse direction is formed by a scan wise movement of the print head assembly while the recording medium is held stationary. The scan wise movement of the print head assembly supports a flexible movement of the print head assembly across the recording medium, which can be adjusted depending on a width of the image across the recording medium. This supports an easy and productive way of forming an image on a recording media, wherein the image and/or the recording media have varying widths along the transverse direction.

In another aspect of the present invention, a printer is provided for forming an image on a recording medium comprising: a print head assembly for applying an ink on the recording medium to form the image, wherein the ink is curable; a transport assembly arranged for moving the recording medium step-wise along a transport path in the transport direction along the print head assembly and a curing system; the curing system comprising a curing source being arranged extending over the transport path in a transverse direction for curing the curable ink in a curing zone on the recording medium, which curing zone is arranged extending over the transport path in the transverse direction, the transverse direction being substantially perpendicular to the transport direction; wherein the printer further comprises a curing control system arranged for controlling a movement of the curing zone along the transport direction through the transport path in response to the step-wise movement of the recording medium.

The curing zone is moveably arranged relative to the transport direction along the transport path. The curing control system controls a movement of the curing zone in the transport direction in response to the step wise movement of the recording medium along the transport path. In this way, the curable ink during curing in the curing zone obtains a uniform curing dose along the transport direction despite the step-wise movement of the recording medium. As a result, a uniform print quality, such as an uniform gloss level, is obtained in the image.

The printer further may comprise a transport assembly arranged for moving the recording medium step-wise along a transport path in the transport direction along the print head assembly and a curing system. In examples, the transport assembly may comprise a transport pinch for transporting the recording medium, may comprise a stepper element configured for a linear movement to transport the recording medium and may comprise a drive roller for transporting the recording medium along the transport path. Preferably, the transport assembly, such as a transport pinch, may be arranged upstream of the print head assembly or may be arranged downstream of the curing system for driving the recording medium in the transport direction. In this way, the recording medium is moved controllably while an image side of the recording medium, on which the image is applied, does not need to be touched by the transport assembly after the curable ink is deposited and before the curable ink is cured. This is advantageous as touching the curable ink on the image side of the recording medium, when the curable ink is not yet cured and still liquid, may disturb the print quality of the image.

The curing control system may comprise at least one drive device for moving a part of the curing system along the transport direction for moving the curing zone along the transport direction. Alternatively, the curing system may comprise a mirror assembly for reflecting a curing radiation to the curing zone and the curing control system may comprise an actuator for rotating the mirror assembly about a rotation axis to adjust an angle of reflection of the curing radiation by the rotating mirror assembly such that the focus of the curing radiation onto the recording medium, i.e. the curing zone, is moved along the transport path in transport direction. Alternatively, the curing source may comprise an array of source devices distributed along the transport direction for defining the curing zone, and the curing control system may comprise at least one switching device for selectively activating at least one of the source devices and selectively deactivating at least one of the source devices in order to move the curing zone along the transport direction.

In an embodiment, the curing source is a UV radiation source arranged for providing a UV radiation onto the curable ink. The UV radiation provides a curing process of a UV curable ink. The UV radiation can suitably be emitted by a UV radiation source and can be easily directed, such as by reflection of the UV radiation, to control a position of the curing zone. The curing zone may be moved along the transport direction by adjusting a reflection path of the UV radiation.

In an embodiment, the curing control system is arranged for moving the curing zone along the transport direction such that in curing operation the velocity of the curing zone relative to the recording medium in the transport direction is substantially constant. In this way, the cure dose received in the curing zone on the recording medium is equalized along the transport direction. As a result, a print quality attribute of a curable ink, which print quality attribute is sensitive to the cure dose, is made more uniform over the image. The curing control system may comprise a motion control unit for determining a relative velocity of the curing zone relative to the recording medium at every stage of the step wise movement of the recording medium along the transport path. The motion control unit may additionally comprise a sensor for measuring the movement of the recording medium along the transport path, such as a sensor arranged facing the transport path at the curing system.

In an embodiment, at least a part of the curing system is moveably arranged along the transport direction for moving the curing zone in the transport direction and the curing control system controls the movement of said part of the curing system along the transport direction. The curing control system may comprise at least one drive device for moving said part of the curing system along the transport direction for moving the curing zone along the transport direction. Said moveable part of the curing system may comprise a curing beam extending over the transport path along the transverse direction.

In a particular embodiment, the printer comprises a gantry movably arranged along the transport direction, wherein the print head assembly is mounted on the gantry, and the curing system is mounted on the gantry. Said part of the curing system may be moved along the transport direction relative to the gantry, e.g. over a short distance, and said gantry including the curing system and the print head assembly may be moved along the transport path over a longer distance.

In an embodiment, the curing source comprises an array of source devices distributed along the transport direction for defining the curing zone, and the curing control system controls the steps of selectively activating at least one of the source devices and selectively deactivating at least one of the source devices for moving the curing zone along the transport direction.

For example, the array of source devices may comprise a group of four source devices arranged along the transport direction. The curing zone may be defined along the transport direction by selectively activating two source devices arranged adjacent to one another along the transport direction from the group of four source devices. The curing zone may be moved in a transport direction along the transport direction by first activating a first source device and a second source device, being adjacent to one another, then deactivating the first source device and activating a third source device, being adjacent to the second source device and then deactivating the second source device and activating a fourth source device, being adjacent to the third source device. In this way, the curing zone is moved along the transport direction by selectively activating at least one of the source devices and selectively deactivating at least one of the source devices.

Alternative implementations of the number of source devices along the transport direction may suitably be selected by the person skilled in the art according to a desired length of the curing zone along the transport direction and a desired motion control of the curing zone in the transport direction.

Further scope of applicability of the present invention will become apparent from the detailed description given hereinafter. However, it should be understood that the detailed description and specific examples, while indicating embodiments of the invention, are given by way of illustration only, since various changes and modifications within the scope of the invention will become apparent to those skilled in the art from this detailed description.

BRIEF DESCRIPTION OF THE DRAWINGS

The present invention will become more fully understood from the detailed description given hereinbelow and the accompanying schematical drawings which are given by way of illustration only, and thus are not limitative of the present invention, and wherein.

DETAILED DESCRIPTION OF THE DRAWINGS

Figure 1A:
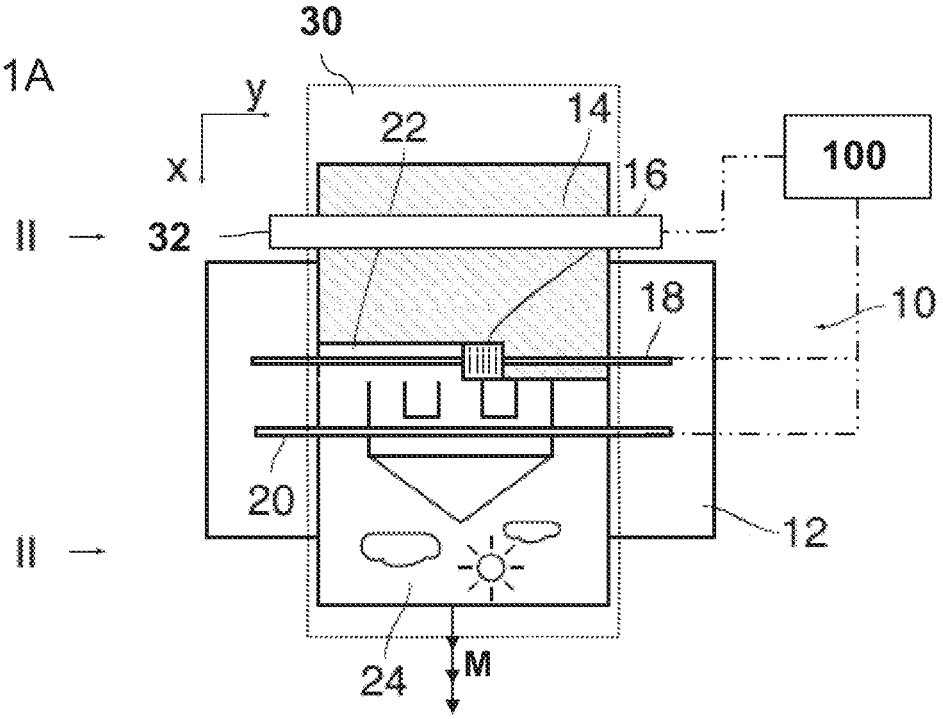
FIG. 1A is a schematic top plan view of an ink jet printer for performing a method according to the invention.

The present invention will now be described with reference to the accompanying drawings, wherein the same reference numerals have been used to identify the same or similar elements throughout the several views.

Figure 1B:
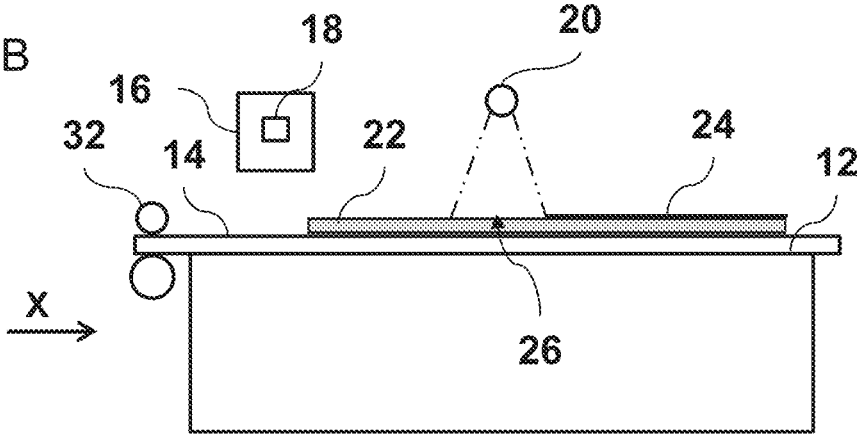
FIG. 1B is an enlarged side view of the printer shown in FIG. 1A, seen in the direction of arrows II-II in FIG. 1A.

FIGS. 1A-1B show an ink jet printer 10 having a print surface 12 that supports a sheet of a recording medium 14. The recording medium 14 is moved along a transport path 30 by a transport assembly 32, such as a transport pinch, over the print surface 12 in a transport direction x. A print head carriage 16 is slidable along a rail 18 that extends across the entire width of the recording medium 14. The carriage 16 is driven to move back and forth in a transverse direction y normal to the transport direction x and carries a print head assembly (symbolized by linear nozzle arrays in the drawing) with which inks of different colours may be expelled onto the recording medium 14 in order to print an image.

A curing system 20 for curing droplets of liquid ink that have been applied onto the recording medium 14 by means of the print heads is configured as a UV lamp source that extends over the entire width of the recording medium 14 across the transport path 30 along the transverse direction y and is disposed downstream of the rail 18 in the transport direction x.

In the example shown, the recording medium 14 is a rigid (symbolized by hatching in the area of the sheet in which no image has been formed as yet). The print heads on the carriage 16 are provided for printing with coloured inks (e.g. UV-curable phase change inks in the colours cyan, magenta, yellow and black) so as to print a colour image 22 on top of the white background layer. The nozzle arrays of the print heads extend in the transport direction x, so that a swath of several pixel lines is printed during each pass of the carriage 16 across the recording medium. In the situation illustrated in FIG. 1, the carriage 16 travels in +y direction and the print heads are used for printing a swath of the coloured image 22.

The transport assembly 32 moves the recording medium 14 in a step wise movement in the transport direction x as indicated by arrow M. A control unit 100 is provided to control the transport assembly 32, the carriage 16 including the print head assembly and the curing system 20. The scan wise movement of the carriage 16 including the print head assembly is synchronized by the control unit 100 with the step wise movement of the recording medium 14 driven by the transport assembly 32.

As shown in FIG. 1B, the UV lamp source 20 emits a UV radiation onto a curing zone 26 positioned on the recording medium 14. In the curing zone 26 the image material of the image 22 is cured, thereby forming a cured image portion as indicated in FIG. 1B by a bold line 24 marking the top surface. The curing zone 26 extends over the transport path 30 in the transverse direction y. In this way, the image 22 is cured in the curing zone 26 at once across the width of the recording medium 14 along the transverse direction y.

In this example, the curable ink is a radiation curable phase change ink. The phase change property of the radiation curable ink stabilizes the droplets applied onto the recording medium 14 before they are cured. For example, the radiation curable phase change ink may form a thermally reversible gelling phase or a thermally reversible solid phase in the curable ink when the curable is applied on the recording medium 14 and cools to a specific temperature, such as room temperature. When a phase change radiation curable ink is used for applying an image 22 onto the recording medium 14, it is not necessary to cure immediately after the droplet has landed onto the recording medium 14; there may be a time interval in between application of the droplets onto the recording medium 14 and curing by the curing system 20, without droplet smearing occurring.

Figure 2A:
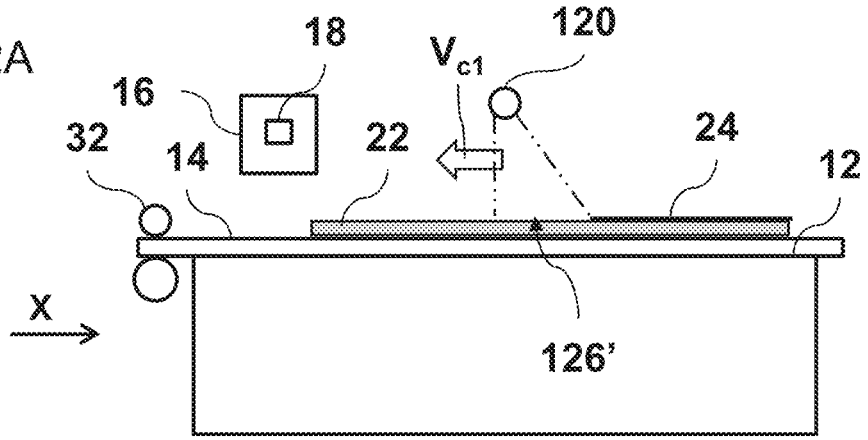
FIGS. 2A and 2B are enlarged side views of an embodiment of the printer shown in FIG. 1A, seen in the direction of arrows II-II in FIG. 1A, for different phases of moving a curing zone.
Figure 2B:
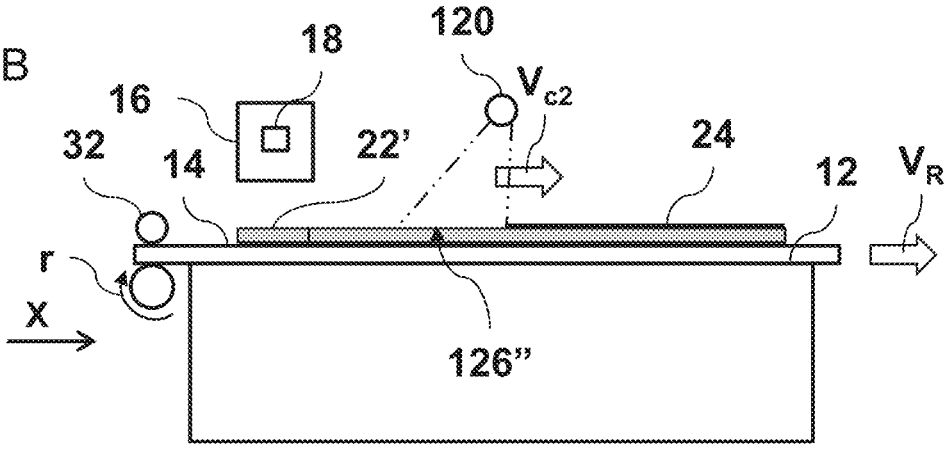

FIGS. 2A and 2B are enlarged side views of an embodiment of the printer shown in FIG. 1A, seen in the direction of arrows II-II in FIG. 1A, for different phases of moving a curing zone.

At the start of a first phase, as shown in FIG. 2A, the lamp constituting the curing system 120 is directed to a curing zone 126'. During the first phase the recording medium 14 is held stationary by the transport pinch 32 with respect to the print surface 12 in the transport direction x of the transport path 30. The carriage 16 including the print head assembly is moved scan wise over the recording medium 14 along the transverse direction y to apply a curable ink to form a swath of the image onto recording medium 14. At the same time, during the first phase, the lamp constituting the curing system 120 is rotated to move the curing zone 126' along the transport path 30 towards the carriage 16 in an upstream direction opposite the transport direction x at a first curing zone velocity $V_{c1}$. Behind the curing zone 126' in the transport direction x the image material of the image 22 is cured, thereby forming a cured image portion as indicated in FIG. 2A by a bold line 24 marking the top surface. Each part of the image 22 receives an equal UV cure dose as the first curing zone velocity $V_{c1}$ is maintained substantially constant during the first phase. During the first phase, a relative velocity $\Delta V_1$ between the curing zone 126' and the recording medium 14 is equal to a first curing zone velocity $V_{c1}$.

FIG. 2B shows a second phase which is started after the first phase shown in FIG. 2A. At the start of a second phase, as shown in FIG. 2B, the lamp constituting the curing system 120 is directed to a curing zone 126", which is a location of the curing zone 126 along the transport path at an upstream end of the possible locations of the curing zone 126 along the transport direction x. A swath of image portion 22' has just been formed on the recording medium 14 by the print head assembly mounted on the carriage 16. During the second phase the recording medium 14 is step wise moved by the transport pinch 32 as indicated by arrow r with respect to the print surface 12 in the transport direction x of the transport path 30 at a velocity indicated by arrow $V_R$. The carriage 16 including the print head assembly is turned in scanning direction at a side of the recording medium 14 in the transverse direction y and no image material is applied onto the recording medium 14 during the second phase. During the second phase, the lamp constituting the curing system 120 is rotated to move the curing zone 126" along the transport path 30 away from the carriage 16 in the transport direction x at a second curing zone velocity $V_{c2}$. The second curing zone velocity $V_{c2}$ is selected such that a relative velocity $\Delta V_2$ between the curing zone 126" and the recording medium 14 ($\Delta V_2 = V_R - V_{c2}$) is substantially constant during the second phase. Furthermore, the second curing zone velocity $V_{c2}$ is lower than the recording medium velocity $V_R$ in the transport direction such that the curing zone 126" moves slower in the transport direction x than the recording medium 14 including the image material 22. As a result, behind the curing zone 126" in the transport direction x the image material of the image 22 is cured, thereby forming a cured image portion as indicated in FIG. 2B by a bold line 24 marking the top surface. Each part of the image 22 receives an equal UV cure dose as the relative velocity $\Delta V_2$ is maintained substantially constant during the second phase. The second curing zone velocity $V_{c2}$ is selected such that a relative velocity $\Delta V_2$ between the curing zone 126" and the recording medium 14 ($\Delta V_2 = V_R - V_{c2}$) during the second phase is substantially equal to the relative velocity $\Delta V_1$ between the curing zone 126' and the recording medium 14 during the first phase shown in FIG. 2A.

In this way, the image 22 receives an equal UV cure dose as the relative velocity $\Delta V_2$ between the curing zone 126" and the recording medium 14 during the second phase shown in FIG. 2B is equal to the relative velocity $\Delta V_1$ between the curing zone 126' and the recording medium 14 during the first phase shown in FIG. 2A. As a result, a gloss level of the cured image 26 is made uniform along the transport direction x. Furthermore, the curing lamp of the curing system 120 is arranged to provide a uniform curing radiation across the curing zone along the transverse direction y. As such, the UV curing dose provided onto the image 22 is uniform both along the transverse direction y and along the recording medium 14 in the transport direction x.

Figure 3A:
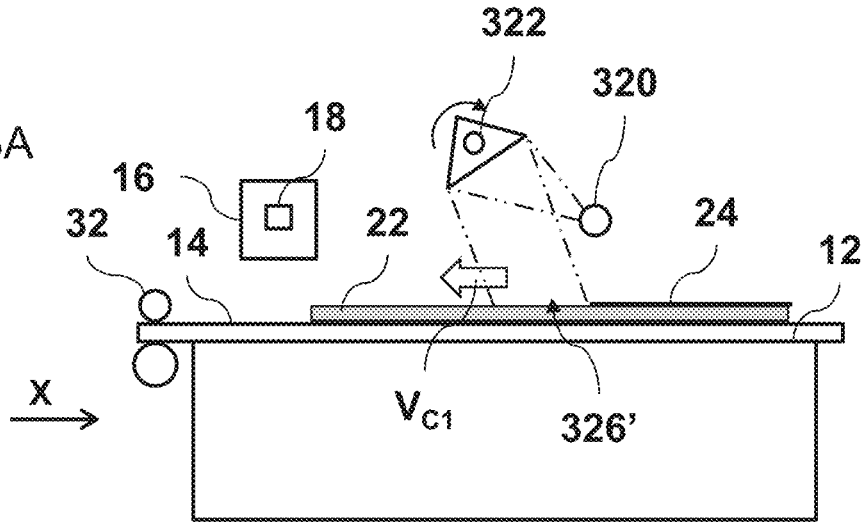
FIGS. 3A and 3B are enlarged side views of another embodiment of the printer shown in FIG. 1A, seen in the direction of arrows II-II in FIG. 1A, for different phases of moving a curing zone.
Figure 3B:
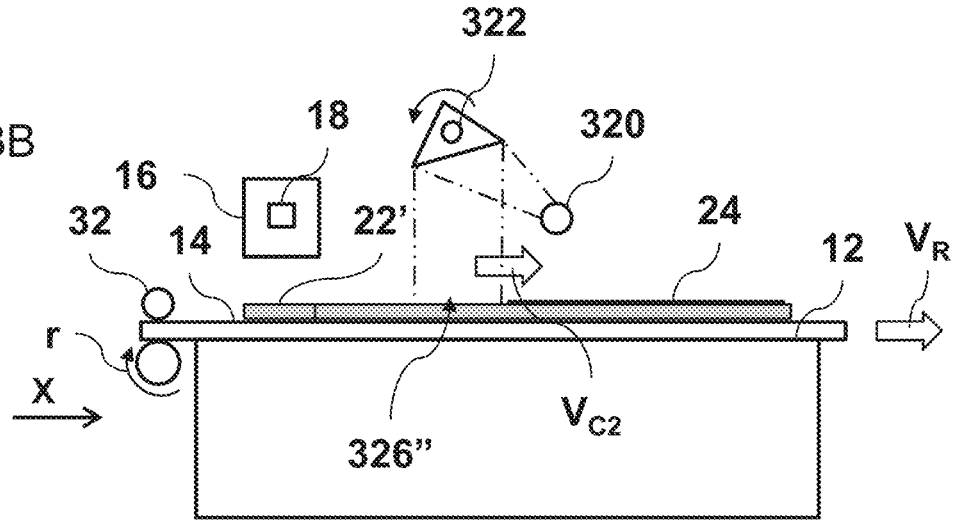

FIGS. 3A and 3B are enlarged side views of another embodiment of the printer shown in FIG. 1A, seen in the direction of arrows II-II in FIG. 1A, for different phases of moving a curing zone. In the printer the curing lamp 320 is provided for emitting a UV curing radiation. The curing system further comprises a mirror assembly 322 arranged to direct the UV curing radiation by way of reflection towards a curing zone 327 on the recording medium 14.

At the start of a first phase, as shown in FIG. 3A, the mirror assembly 322 is arranged to reflect the curing radiation, which is emitted by the lamp constituting the curing system 120, to a curing zone 326'. During the first phase the recording medium 14 is held stationary by the transport pinch 32 with respect to the print surface 12 in the transport direction x of the transport path 30. The carriage 16 including the print head assembly is moved scan wise over the recording medium 14 along the transverse direction y to apply a curable ink to form a swath of the image onto recording medium 14. At the same time, during the first phase, the mirror assembly 322 is rotated to move the curing zone 326' along the transport path 30 towards the carriage 16 in an upstream direction opposite the transport direction x at a first curing zone velocity $V_{c1}$. Behind the curing zone 326' in the transport direction x the image material of the image 22 is cured, thereby forming a cured image portion as indicated in FIG. 3A by a bold line 24 marking the top surface. Each part of the image 22 receives an equal UV cure dose as the first curing zone velocity $V_{c1}$ is maintained substantially constant during the first phase. During the first phase, a relative velocity $\Delta V_1$ between the curing zone 326' and the recording medium 14 is equal to first curing zone velocity $V_{c1}$.

FIG. 3B shows a second phase which is started after the first phase shown in FIG. 3A. At the start of a second phase, as shown in FIG. 3B, the mirror assembly 322 is arranged to reflect the curing radiation to a curing zone 326", which arranged along the transport path at an upstream end of the possible locations of the curing zone 326 along the transport direction x. A swath of image portion 22' has just been formed on the recording medium 14 by the print head assembly mounted on the carriage 16. During the second phase the recording medium 14 is step wise moved by the transport pinch 32 as indicated by arrow r with respect to the print surface 12 in the transport direction x of the transport path 30 at a velocity indicated by arrow $V_R$. The carriage 16 including the print head assembly is turned in scanning direction at a side of the recording medium 14 in the transverse direction y and no image material is applied onto the recording medium 14 during the second phase. During the second phase, the mirror assembly 322 is rotated to move the curing zone 326" along the transport path 30 away from the carriage 16 in the transport direction x at a second curing zone velocity $V_{c2}$. The second curing zone velocity $V_{c2}$ is selected such that a relative velocity $\Delta V_2$ between the curing zone 326" and the recording medium 14 ($\Delta V_2=V_R-V_{c2}$) is substantially constant during the second phase. Furthermore, the second curing zone velocity $V_{c2}$ is lower than the recording medium velocity $V_R$ in the transport direction such that the curing zone 326" moves slower in the transport direction x than the recording medium 14 including the image material 22. As a result, behind the curing zone 326" in the transport direction x the image material of the image 22 is cured, thereby forming a cured image portion as indicated in FIG. 3B by a bold line 24 marking the top surface. Each part of the image 22 receives an equal UV cure dose as the relative velocity $\Delta V_2$ is maintained substantially constant during the second phase. The second curing zone velocity $V_{c2}$ is selected such that a relative velocity $\Delta V_2$ between the curing zone 326" and the recording medium 14 ($\Delta V_2=V_{c2}$) during the second phase is substantially equal to the relative velocity $\Delta V_1$ between the curing zone 126' and the recording medium 14 during the first phase shown in FIG. 3A.

In this way, the image 22 receives an equal UV cure dose as the relative velocity $\Delta V_2$ between the curing zone 326" and the recording medium 14 during the second phase shown in FIG. 3B is equal to the relative velocity $\Delta V_1$ between the curing zone 326' and the recording medium 14 during the first phase shown in FIG. 3A.

Figure 4A:
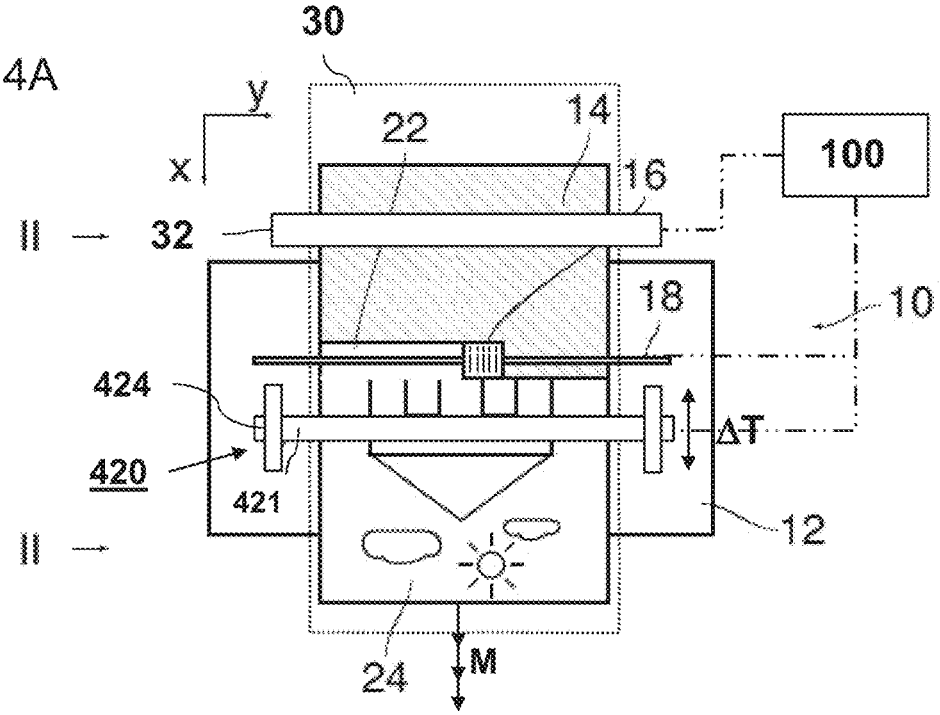
FIG. 4A is a schematic top plan view of an example of a printer according to another embodiment of the invention.

FIG. 4A shows a schematic top plan view of an example of a printer according to another embodiment of the invention. The inkjet printer 10 has a print surface 12 that supports a sheet of a recording medium 14. The recording medium 14 is moved along a transport path 30 by a transport assembly 32, such as a transport pinch, over the print surface 12 in a transport direction x. A print head carriage 16 is slidable along a rail 18 that extends across the entire width of the recording medium 14. The carriage 16 is driven to move back and forth in a transverse direction y normal to the transport direction x and carries a print head assembly (symbolized by linear nozzle arrays in the drawing) with which inks of different colours may be expelled onto the recording medium 14 in order to print an image.

A curing system 420 for curing droplets of liquid ink that have been applied onto the recording medium 14 by means of the print heads comprises a curing beam 421 and UV lamp source 422 that extends over the entire width of the recording medium 14 across the transport path 30 along the transverse direction y and is disposed downstream of the rail 18 in the transport direction x. The curing system 420 further comprises a rail assembly 424 arranged at both ends of the curing beam 421 for movably supporting the curing beam 421 including the curing lamp 420 along the transport direction x. The rail assembly 424 enables a movement of the curing beam 421 including the curing lamp 420 along the transport direction x over a transport distance ΔT. A movement of the curing beam 421 in the transport direction along the gear assembly 424 is driven by at least one actuator (not shown), which is controlled by the control unit 100. The control unit 100 is configured to further control the transport assembly 32, the carriage 16 including the print head assembly and the curing source 422 of the curing system 420.

The transport assembly 32 moves the recording medium 14 in a step wise movement in the transport direction x as indicated by arrow M. A scan wise movement of the carriage 16 including the print head assembly along the transverse direction y is synchronized by the control unit 100 with the step wise movement of the recording medium 14 driven by the transport assembly 32.

Figure 4B:
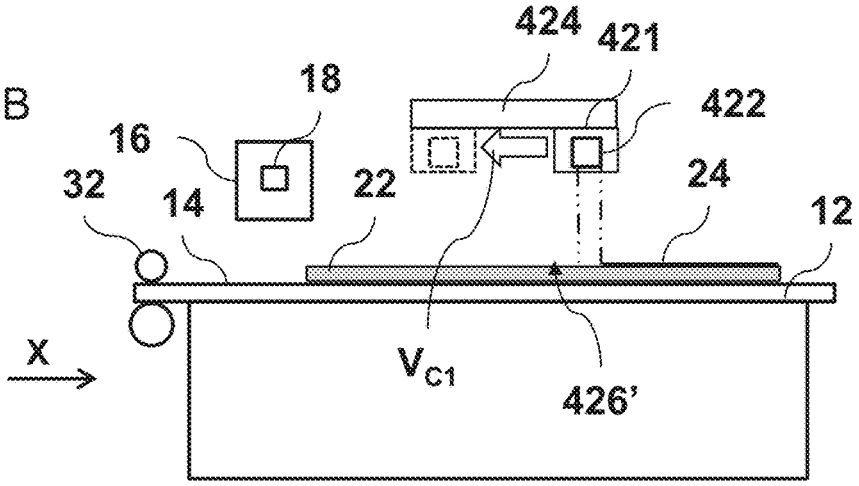
FIGS. 4B and 4C are enlarged side views of the embodiment of the printer shown in FIG. 4A, seen in the direction of arrows II-II in FIG. 4A, for different phases of moving a curing zone.
Figure 4C:
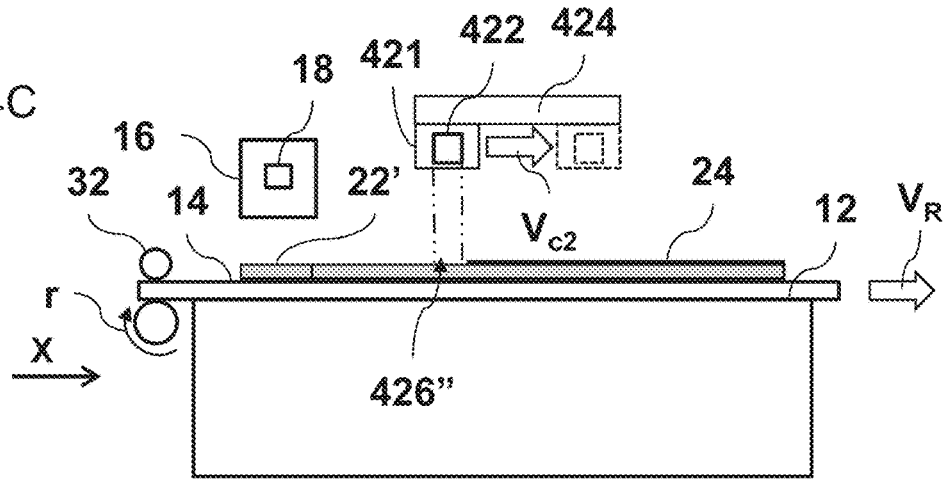

FIGS. 4B and 4C show enlarged side views of the embodiment of the printer shown in FIG. 4A, seen in the direction of arrows II-II in FIG. 4A, for different phases of moving a curing zone.

At the start of a first phase, as shown in FIG. 4B, the lamp source of the curing system 422 is held by the curing beam 421 at an downstream end position of the rail assembly 421 along the transport direction x to direct the radiation curing to a curing zone 426'. During the first phase the recording medium 14 is held stationary by the transport pinch 32 with respect to the print surface 12 in the transport direction x of the transport path 30. The carriage 16 including the print head assembly is moved scan wise over the recording medium 14 along the transverse direction y to apply a curable ink to form a swath of the image onto recording medium 14. At the same time, during the first phase, the curing beam 421 including the lamp source 422 is moved along the transport path 30 towards the carriage 16 in an upstream direction opposite the transport direction x to move the curing zone 426' at a first curing zone velocity $V_{c1}$. Behind the curing zone 426' in the transport direction x the image material of the image 22 is cured, thereby forming a cured image portion as indicated in FIG. 4B by a bold line 24 marking the top surface. Each part of the image 22 receives an equal UV cure dose as the first curing zone velocity $V_{c1}$ is maintained substantially constant during the first phase. During the first phase, a relative velocity $\Delta V_1$ between the curing zone 426' and the recording medium 14 is equal to a first curing zone velocity $V_{c1}$.

FIG. 4C shows a second phase which is started after the first phase shown in FIG. 4B. At the start of the second phase, as shown in FIG. 4C, the lamp source 422 is positioned by the rail assembly 424 to emit the curing radiation to a curing zone 426", which is arranged along the transport path at an upstream end of the possible locations of the curing zone 426 along the transport direction x. A swath of image portion 22' has just been formed on the recording medium 14 by the print head assembly mounted on the carriage 16. During the second phase the recording medium 14 is step wise moved by the transport pinch 32 as indicated by arrow r with respect to the print surface 12 in the transport direction x of the transport path 30 at a velocity indicated by arrow $V_R$. The carriage 16 including the print head assembly is turned in scanning direction at a side of the recording medium 14 in the transverse direction y and no image material is applied onto the recording medium 14 during the second phase. During the second phase, the curing beam 421 is moved along the rail assembly 424 to move the curing zone 426" along the transport path 30 away from the carriage 16 in the transport direction x at a second curing zone velocity $V_{c2}$. The second curing zone velocity $V_{c2}$ is selected such that a relative velocity $\Delta V_2$ between the curing zone 426" and the recording medium 14 ($\Delta V_2=V_R-V_{c2}$) is substantially constant during the second phase. Furthermore, the second curing zone velocity $V_{c2}$ is lower than the recording medium velocity $V_R$ in the transport direction such that the curing zone 426" moves slower in the transport direction x than the recording medium 14 including the image material 22. As a result, behind the curing zone 426" in the transport direction x the image material of the image 22 is cured, thereby forming a cured image portion as indicated in FIG. 4C by a bold line 24 marking the top surface. Each part of the image 22 receives an equal UV cure dose as the relative velocity $\Delta V_2$ is maintained substantially constant during the second phase.

The second curing zone velocity $V_{c2}$ is selected such that a relative velocity $\Delta V_2$ between the curing zone 426" and the recording medium 14 ($\Delta V_2=V_R-V_{c2}$) during the second phase is substantially equal to the relative velocity $\Delta V_1$ between the curing zone 426' and the recording medium 14 during the first phase shown in FIG. 4B.

Figure 5A:
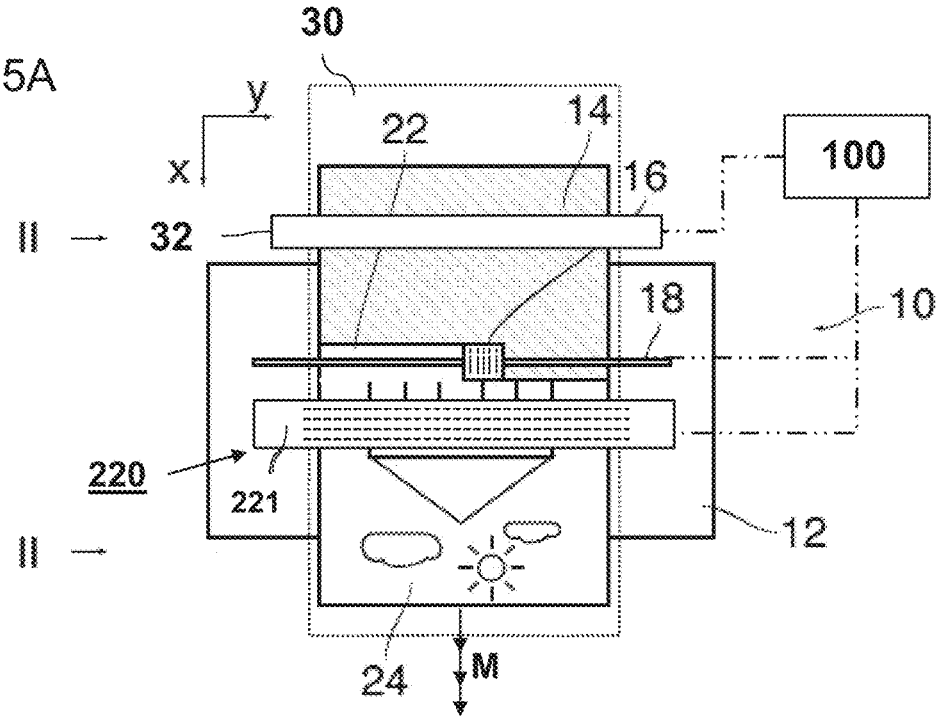
FIG. 5A is a schematic top plan view of an example of a printer according to another embodiment of the invention.

FIG. 5A shows a schematic top plan view of an example of a printer according to another embodiment of the invention. The inkjet printer 10 is similar to the one described in relation to FIG. 4A. Furthermore, a modified curing system 220 is provided for curing droplets of liquid ink that have been applied onto the recording medium 14 by means of the print heads. The curing system comprises a curing beam 221 extending across the transport path 30 in the transverse direction y and a plurality of UV lamp source 222*a*-222*d* mounted onto the curing beam 221 (symbolized by an array of lines in the drawing, see further FIG. 5B). The plurality of UV lamp source 222*a*-222*d* are distributed along the transport direction x, each of UV lamp sources 222*a*-222*d* extending over the entire width of the recording medium 14 across the transport path 30 along the transverse direction y and being disposed downstream of the rail 18 in the transport direction x. In this embodiment, one of the UV lamp sources 222*a*-222*d* is selected to be activated to emit a curing radiation towards the recording medium 14 for providing a curing zone. Alternatively, more than one of the UV lamp sources 222*a*-222*d* may be activated simultaneously to define a curing zone having a larger length along the transport direction x.

The control unit 100 is configured to further control the transport assembly 32, the carriage 16 including the print head assembly and each of the curing lamp sources 222*a*-222*d* of the curing system 220.

The transport assembly 32 moves the recording medium 14 in a step wise movement in the transport direction x as indicated by arrow M. A scan wise movement of the carriage 16 including the print head assembly along the transverse direction y is synchronized by the control unit 100 with the step wise movement of the recording medium 14 driven by the transport assembly 32.

Figure 5B:
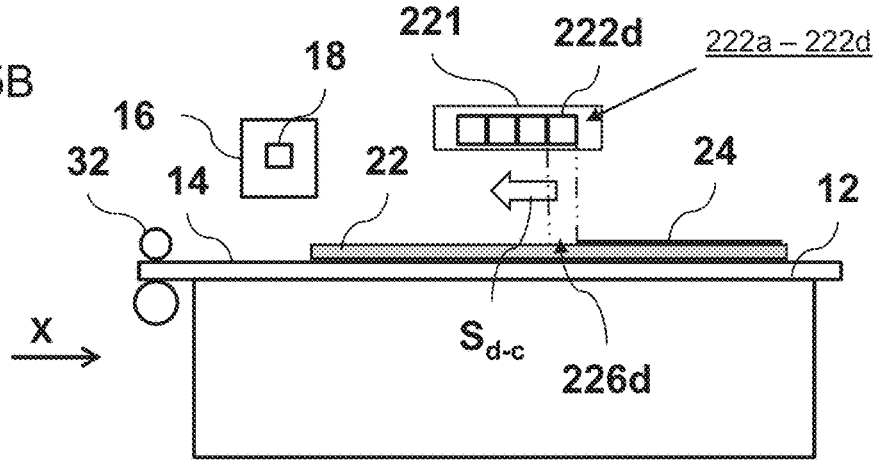
FIGS. 5B-5D are enlarged side views of the embodiment of the printer shown in FIG. 5A, seen in the direction of arrows II-II in FIG. 5A, for different phases of moving a curing zone.
Figure 5C:
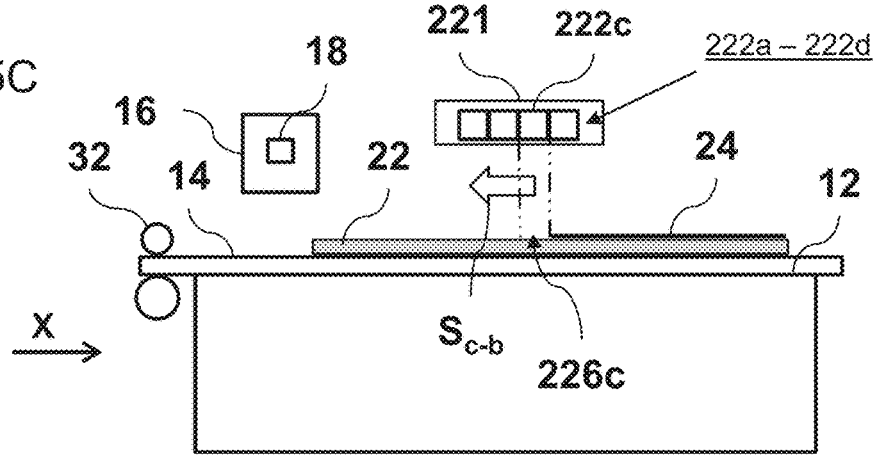
Figure 5D:
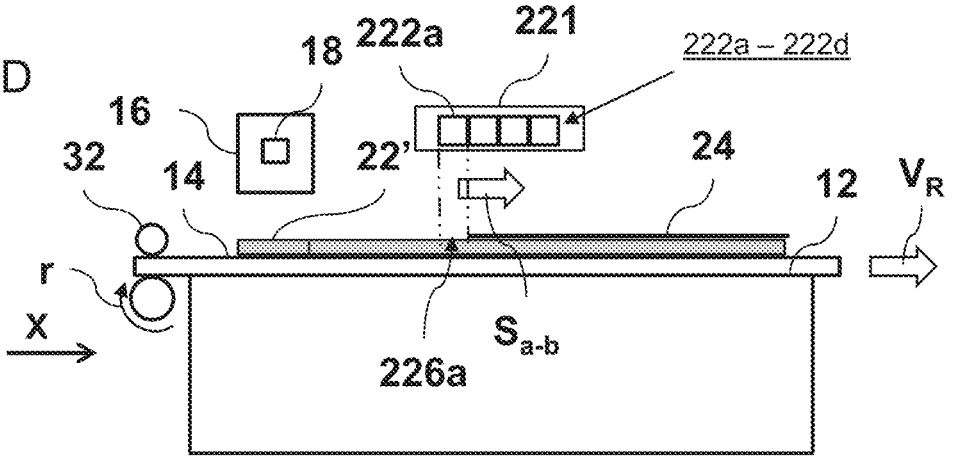

FIGS. 5B-5D show enlarged side views of the embodiment of the printer shown in FIG. 5A, seen in the direction of arrows II-II in FIG. 5A, for different phases of moving a curing zone.

At a first step of a first phase, as shown in FIG. 5B, a fourth one of lamp sources of the curing system 222*d* is activated by the control unit 100 at an downstream end position along the transport direction x to emit the radiation curing to a curing zone 226*d*. During the first phase the recording medium 14 is held stationary by the transport pinch 32 with respect to the print surface 12 in the transport direction x of the transport path 30. The carriage 16 including the print head assembly is moved scan wise over the recording medium 14 along the transverse direction y to apply a curable ink to form a swath of the image onto recording medium 14. During the first step of the first phase, the selected lamp source of the curing system 222*d* is activated for a certain activation period $P_{A,4}$ to apply a UV dose onto the image material in the curing zone 226*d*. As the recording medium is held stationary a curing period $T_C$ for each part of the image 22 in the curing zone 226*d* is equal to the activation period $P_{A,4}$ of the fourth lamp source 222*d*. At the end of the first step of the first phase, the curing zone 226 is moved upstream relative to the transport direction x by deactivating the fourth lamp source 222*d* and activating a third, neighbouring, lamp source 222*c*, as indicated by arrow S.

At a second step of the first phase, as shown in FIG. 5C, the third of lamp sources of the curing system 222*c* is activated by the control unit 100 to emit the radiation curing to a curing zone 226*c*. During the second step of the first phase, the selected lamp source of the curing system 222*c* is activated for a certain activation period $P_{A,3}$ to apply a UV dose onto the image material in the curing zone 226*c*. As the recording medium is held stationary a curing period $T_C$ for each part of the image 22 in the curing zone 226*c* is equal to the activation period $P_{A,3}$ of the third lamp source 222*c*. The UV dose of the second step is equal to the UV dose of the first step. At the end of the second step of the first phase, the curing zone 226 is step wise moved upstream relative to the transport direction x by deactivating the third lamp source 222*c* and activating a second, neighbouring, lamp source 222*b*, as indicated by arrow $S_{c-b}$.

At a third step of the first phase (not shown), the second lamp source of the curing system 222*b* is activated for a certain activation period $P_{A,2}$ to apply a UV dose onto the image material in a curing zone of the second lamp source 222*b*. At a fourth step of the first phase (not shown), the first lamp source of the curing system 222*a* is activated for a certain activation period $P_{A,1}$ to apply a UV dose onto the image material in a curing zone of the first lamp source 222*a*. The curing zones of the plurality of lamp sources 222*a*-222*d* are arranged adjacent one another in the transport direction x.

The UV dose and the curing periods Tc provided during each step of the first phase in the respective curing zones onto the recording medium is substantially equally to one another. In this way, the UV dose provided during the first phase onto the image material 22 on the recording medium 14 is substantially uniform along the transport direction x.

Behind the curing zone 226 in the transport direction x the image material of the image 22 is cured, thereby forming a cured image portion as indicated in FIGS. 5B and 5C by a bold line 24 marking the top surface.

At a first step of a second phase, as shown in FIG. 5D, the first lamp source 222*a* is activated by the control unit 100 at an upstream end position along the transport direction x to emit the radiation curing to a curing zone 226*a*. The first step of the second phase is started just after the fourth step of the first phase. A swath of image portion 22' has just been formed on the recording medium 14 by the print head assembly mounted on the carriage 16. During the second phase the recording medium 14 is step wise moved by the transport pinch 32 as indicated by arrow r with respect to the print surface 12 in the transport direction x of the transport path 30 at a velocity indicated by arrow $V_R$. The carriage 16 including the print head assembly is turned in scanning direction at a side of the recording medium 14 in the transverse direction y and no image material is applied onto the recording medium 14 during the second phase. In the first step of the second phase, the curing zone 226 is moved downstream relative to the transport direction x by deactivating the first lamp source 222*a* and activating the second, neighbouring, lamp source 222*b*, as indicated by arrow $S_{a-b}$.

After a certain activation period of the second lamp source 222*b*, the curing zone 226 is again moved downstream relative to the transport direction x by deactivating the second lamp source 222*b* and activating the third, neighbouring, lamp source 222*c*. Subsequently, after a same activation period of the third lamp source 222*c*, the curing zone 226 is again moved downstream relative to the transport direction x by deactivating the third lamp source 222*b* and activating the fourth, neighbouring, lamp source 222*d*. The activation period of each of the lamp sources 222*a*-222*d* during the second phase is selected such that each part of the image 22 receives a same UV dose along the transport direction x, i.e. independent of the step wise movement of the recording medium during the first phase and the second phase.

In particular, the activation period $T_A$ of each lamp source 222*a*-222*d* during the second phase is selected such that a curing period $T_C$, i.e. a period wherein the image material is exposed to the curing radiation, is substantially equal for each part of the image 22 along the transport direction x. As the recording medium is moved in the transport direction x during the second phase, the activation period $T_A$ is selected shorter than the curing period $T_C$, thereby step-wise moving the curing zone 226 in the transport direction x during the second phase. In this way, a certain part of the image 22 receives the UV curing dose from a plurality of lamp sources 222*a*-222*d* during the second phase.

For example, said part of the image 22 may be exposed to a portion of an activation period of the first lamp source 222*a* ($x*T_{A,1}$) plus a portion of an activation period of the second lamp source 222*b* ($y*T_{A,2}$), thereby providing a curing period $T_C=x*T_{A,1}+y*T_{A,2}$, wherein x and y are both $\leq 1$ and $x+y>1$.

The curing period of said part of the image 22 in the second phase is substantially equal to a curing period of another part of the image 22 during the first phase (wherein the recording medium is held stationary with respect to the transport path along the transport direction x).

Detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any advantageous combination of such claims are herewith disclosed.

Further, it is contemplated that structural elements may be generated by application of three-dimensional (3D) printing techniques. Therefore, any reference to a structural element is intended to encompass any computer executable instructions that instruct a computer to generate such a structural element by three-dimensional printing techniques or similar computer controlled manufacturing techniques. Furthermore, such a reference to a structural element encompasses a computer readable medium carrying such computer executable instructions.

Further, the terms and phrases used herein are not intended to be limiting; but rather, to provide an understandable description of the invention. The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. Method for forming an image on a recording medium in a printer, the printer comprising a print head assembly for applying a curable ink on a recording medium to form the image, a transport path arranged for moving the recording medium in a transport direction along the print head assembly and a curing system; said curing system comprising a curing source; the method comprising the steps of:

a) moving the recording medium through the transport path in a step-wise movement in the transport direction along the print head assembly and the curing system;

b) applying the curable ink on the recording medium by the print head assembly to form the image; and c) curing the curable ink, which is applied on the recording medium, by the curing source in a curing zone on the recording medium, the curing source and the curing zone extending over the transport path in a transverse direction, the transverse direction being substantially perpendicular to the transport direction; wherein the curing step c) comprises moving the curing zone along the transport direction through the transport path in response to the step-wise movement of the recording medium according to step a).

2. Method according to claim 1, wherein during the curing step c) the curing zone is moved along the transport direction such that the velocity of the curing zone relative to the recording medium in the transport direction is substantially constant.

3. Method according to claim 1, wherein the curable ink further comprises a phase change component for forming a gelling phase in the curable ink or forming a thermally reversible solid phase in the curable ink.

4. Method according to claim 1, wherein at least a part of the curing system is moveably arranged along the transport direction and in the curing step c) the moving step of the curing zone in the transport direction comprises moving a part of the curing system along the transport direction.

5. Method according to claim 1, wherein the curing source comprises an array of source devices distributed along the transport direction for defining the curing zone, and in the curing step c) the moving step of the curing zone along the transport direction comprises the steps of selectively activating at least one of the source devices and selectively deactivating at least one of the source devices.

6. Method according to claim 1, wherein in step b) the print head assembly is moved scan wise over the recording medium along the transverse direction, and wherein the scan wise movement of the print head assembly is synchronized with the step-wise movement of the recording medium of step a).

7. Method according to claim 1, wherein in the curing step c) the curing source emits a curing radiation to the curing zone for curing the curable ink.

8. Method according to claim 7, wherein the curing system further comprises a mirror assembly for directing the curing radiation onto the curing zone, and in the curing step c) the moving step of the curing zone along the transport direction comprises rotating the mirror assembly about a rotating axis arranged substantially parallel to the transverse direction.

9. A printer for forming an image on a recording medium comprising:

a print head assembly for applying an ink on the recording medium to form the image, wherein the ink is curable; and a transport assembly arranged for moving the recording medium step-wise along a transport path in the transport direction along the print head assembly and a curing system;

the curing system comprising a curing source being arranged extending over the transport path in a transverse direction for curing the curable ink in a curing zone on the recording medium, which curing zone is arranged extending over the transport path in the transverse direction, the transverse direction being substantially perpendicular to the transport direction;

wherein the printer further comprises a curing control system arranged for controlling a movement of the curing zone along the transport direction through the transport path in response to the step-wise movement of the recording medium.

10. The printer according to claim 9, wherein the curing source is a UV radiation source arranged for providing a UV radiation onto the curable ink.

11. The printer according to claim 9, wherein the curing control system is arranged for moving the curing zone along the transport direction such that in curing operation the velocity of the curing zone relative to the recording medium in the transport direction is substantially constant.

12. The printer according to claim 9, wherein at least a part of the curing system is moveably arranged along the transport direction for moving the curing zone along the transport direction and the curing control system controls the movement of said part of the curing system along the transport direction.

13. The printer according to claim 9, wherein the curing source comprises an array of source devices distributed along the transport direction for defining the curing zone, and the curing control system controls the steps of selectively activating each of the source devices and selectively deactivating each of the source devices for moving the curing zone in the transport direction.

* * * * *